US008979572B2

(12) United States Patent
Mochizuki

(10) Patent No.: US 8,979,572 B2
(45) Date of Patent: Mar. 17, 2015

(54) CONNECTION STRUCTURE OF ELECTRONIC COMPONENT

(71) Applicant: Yazaki Corporation, Tokyo (JP)

(72) Inventor: Shinji Mochizuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/897,134

(22) Filed: May 17, 2013

(65) Prior Publication Data

US 2013/0252485 A1 Sep. 26, 2013

Related U.S. Application Data

(63) Continuation of application No. PCT/JP2011/079126, filed on Dec. 9, 2011.

(30) Foreign Application Priority Data

Dec. 22, 2010 (JP) ..... 2010-286238

(51) Int. Cl.
*H01R 4/26* (2006.01)
*H01R 13/17* (2006.01)
(Continued)

(52) U.S. Cl.
CPC ..... *H01R 13/17* (2013.01); *H01R 13/4223* (2013.01); *H01R 13/66* (2013.01); *H01R 13/6616* (2013.01); *H01R 13/6641* (2013.01); *H01R 13/7175* (2013.01); *H01R 33/09* (2013.01); *H01R 13/112* (2013.01)
USPC ..... 439/417; 439/620.01

(58) Field of Classification Search
USPC ..... 439/404–419, 620.01, 620.04
See application file for complete search history.

(56) References Cited

U.S. PATENT DOCUMENTS 5,443,394 A 8/1995 Billman et al.
5,989,057 A 11/1999 Gerke et al.
(Continued)

FOREIGN PATENT DOCUMENTS

CN 1115124 A 1/1996
CN 1182289 A 5/1998
(Continued)

OTHER PUBLICATIONS

International Search Report and Written Opinion of the International Search Report for PCT/JP2011/079126 dated Mar. 7, 2012.
(Continued)

*Primary Examiner* — Khiem Nguyen
(74) *Attorney, Agent, or Firm* — Kenealy Vaidya LLP

(57) ABSTRACT

A connection structure includes a housing; terminals fixed in the housing; and an electronic component accommodated inside the housing and connected to the terminals. Each terminal includes: a base portion; a protrusion piece extending from the base portion in a lateral direction; and an elastic contact piece extending from the base portion in the lateral direction so that a distance between the protrusion piece and the elastic contact piece becomes shorter towards an end of the elastic contact piece separate away from the base portion. The housing includes a terminal-fixing part protruded from a wall surface of the housing at a position between the protrusion piece and the elastic contact piece near the base portion of the terminal to clamp and fix the protrusion piece between the terminal-fixing part and a wall of the housing.

5 Claims, 16 Drawing Sheets

(51) Int. Cl.

| | |
|---|---|
| ***H01R 13/422*** | (2006.01) |
| ***H01R 13/66*** | (2006.01) |
| ***H01R 13/717*** | (2006.01) |
| ***H01R 33/09*** | (2006.01) |
| *H01R 13/11* | (2006.01) |

(56) References Cited

U.S. PATENT DOCUMENTS

| | | | | |
|---|---|---|---|---|
| 7,160,140 | B1 * | 1/2007 | Mrakovich et al. | 439/417 |
| 7,210,957 | B2 * | 5/2007 | Mrakovich et al. | 439/404 |
| 7,442,070 | B2 * | 10/2008 | Lee | 439/417 |
| 2013/0252469 | A1 | 9/2013 | Mochizuki | |

FOREIGN PATENT DOCUMENTS

| | | | |
|---|---|---|---|
| FR | 2422267 | A1 | 11/1979 |
| JP | 11-162584 | A | 6/1999 |
| JP | 2007-149762 | A | 6/2007 |
| JP | 2010-282751 | A | 12/2010 |
| JP | 2012-134055 | A | 7/2012 |

OTHER PUBLICATIONS

Japanese Office Action for the related Japanese Patent Application No. 2010-286238 dated Sep. 16, 2014.

Chinese Office Action and Search Report for the related Chinese Patent Application No. 201180062533.7 dated Dec. 31, 2014.

* cited by examiner

CONNECTION STRUCTURE OF ELECTRONIC COMPONENT

CROSS REFERENCE TO RELATED APPLICATIONS

This application is a continuation of PCT application No. PCT/JP2011/079126, which was filed on Dec. 9, 2011 based on Japanese Patent Application (No. 2010-286238) filed on Dec. 22, 2010, the contents of which are incorporated herein by reference.

BACKGROUND OF THE INVENTION

1. Field of the Invention

The present invention relates to a connection structure which electrically connects an electronic component by a terminal.

2. Description of the Related Art

In a connection structure of an electronic component (or an electronic-component connection structure) according to a related art which electrically connects electronic components by a pair of terminals, the pair of terminals are accommodated and fixed in a housing, and the electronic components are electrically connected by the pair of terminals. This electronic-component connection structure requires the reliability of the connection of the electronic components and the terminals. Therefore, an electronic-component connection structure which accurately positions electronic components with respect to terminals and connects the electronic components with the terminals has been proposed (see, for example, JP-2007-149762A).

The electronic-component connection structure disclosed in JP-2007-149762A is an electronic-component connection structure which is used for an electronic device and includes a housing, and terminals provided in the housing and having press-contact blades disposed to face each other for being electrically connected with electronic components for circuit protection by pressing, and in which a positioning rib is formed for positioning lead portions of the electronic components, disposed adjacent to the press-contact blades, toward the press-contact blades.

SUMMARY OF THE INVENTION

However, in the electronic-component connection structure disclosed in JP-2007-149762A, since locking portions are formed at the terminals to protrude in a vertical direction of the device, and the terminals are fixed at predetermined positions on the bottom surface of the housing by the locking portions, a thickness of the connection structure in its vertical direction increases, and thus it is difficult to make the connection structure thinner.

The present invention has been made considering the problem, and an object of the present invention is to provide an electronic-component connection structure capable of enabling a reduction in thickness.

According to a first aspect of the present invention, there is provided a connection structure, including: a box-shaped housing having at least side walls which face each other; a pair of terminals which are inserted into the housing to be fixed inside the housing vertically in parallel to planes of the side walls; and an electronic component which is accommodated inside the housing by being connected to the pair of terminals, wherein each terminal of the pair of terminals includes: a base portion; a protrusion piece extending from the base portion in a lateral direction parallel to a bottom plane and the planes of the side walls of the housing; and an elastic contact piece extending from the base portion in the lateral direction so that a distance between the protrusion piece and the elastic contact piece becomes shorter towards an end of the elastic contact piece separate away from the base portion, wherein the housing includes a terminal-fixing part which is protruded from a wall surface of the housing at a position between the protrusion piece and the elastic contact piece near the base portion of the terminal when the terminal is inserted into the housing to clamp and fix the protrusion piece between the terminal-fixing part and one of a bottom wall or an upper wall of the housing.

A second aspect of the present invention provides the connection structure, wherein the terminal-fixing part is formed on a wall surface of the side walls of the housing.

A third aspect of the present invention provides the connection structure, wherein the housing includes a separation wall which divides an accommodation space in the housing into two accommodation spaces in which the pair of terminals are accommodate, respectively, and the terminal-fixing part is formed on a wall surface of the separation wall of the housing.

A fourth aspect of the present invention provides the connection structure, wherein the housing opens at an upper face, and the protrusion piece is clamped and fixed between the terminal-fixing part and the bottom wall of the housing.

A fifth aspect of the present invention provides the connection structure, wherein the terminal-fixing part includes an inclined surface having an upper end and a lower end which is closer to the bottom wall than the upper end, the lower end of the inclined surface being more separate away from the wall surface than the upper end.

According to the electronic-component connection structure in the first aspect of the present invention, each terminal of the pair of terminals is not required to protrude a fixing means in a vertical direction, and it is possible to fix the terminals in the housing by effectively using the dead space between the protrusion pieces and the contact pieces. Therefore, it is possible to fix the terminals in the housing without increasing a dimension in the vertical direction, and thus reduce the thickness.

Further, according to the electronic-component connection structure in the second aspect of the present invention, since the terminal-fixing part is formed at the side surface of the housing, it is possible to fix the terminals in the housing without increasing the dimension in the vertical direction.

Further, according to the electronic-component connection structure in the third aspect of the present invention, since the terminal-fixing part is formed at the surface of separation wall which divides the housing into two accommodation spaces, it is possible to fix the terminals in the housing without increasing the dimension in the vertical direction.

Furthermore, according to the electronic-component connection structure in the fourth aspect of the present invention, since the housing has an opened upper face, and the terminal-fixing parts clamp the protrusion pieces in cooperation with the bottom wall of the housing, it is not necessary to provide a wall at the upper face of the housing for fixing the terminals. Therefore, it is possible to fix the terminals in the housing without increasing a dimension in the vertical direction, and thus reduce the thickness.

Moreover, according to the electronic-component connection structure in the fifth aspect of the present invention, since each terminal-fixing part has the inclined surface having an upper end and a lower end which is closer to the bottom wall than the upper end, the lower end of the inclined surface being more separate away from the wall surface than the upper end, when each terminal of the pair of terminals is accommodated from over the housing into the housing, it is possible to easily dispose the protrusion pieces between the terminal-fixing part and the wall forming the bottom wall of the housing.

DETAILED DESCRIPTION OF THE EXEMPLARY EMBODIMENTS

Hereinafter, a connection structure of an electronic component (or an electronic-component connection structure) according to an embodiment of the present invention will be described in detail with reference to the accompanying drawings.

Embodiment

Figure 1:
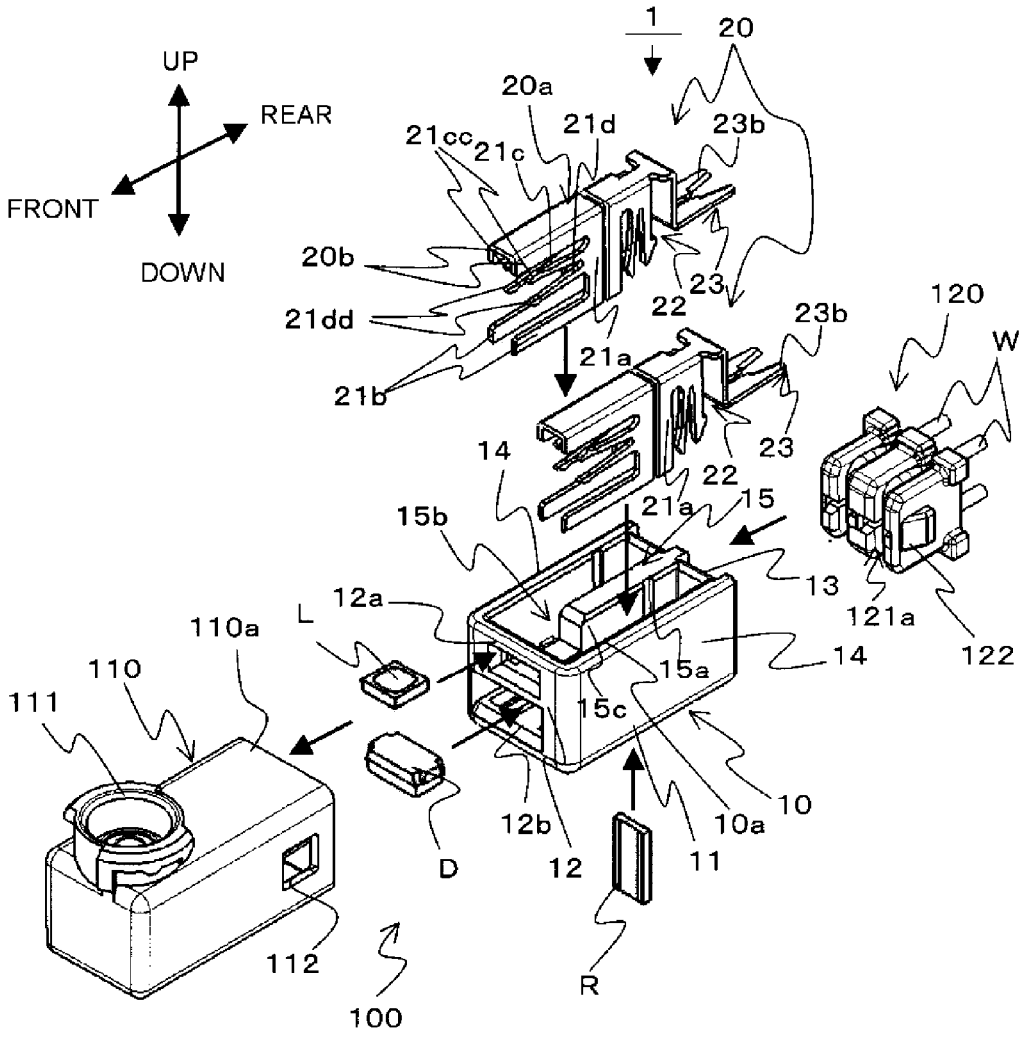
FIG. 1 is an exploded perspective view illustrating a configuration of an LED lighting unit having an electronic-component connection structure according to an embodiment of the present invention.
Figure 2:
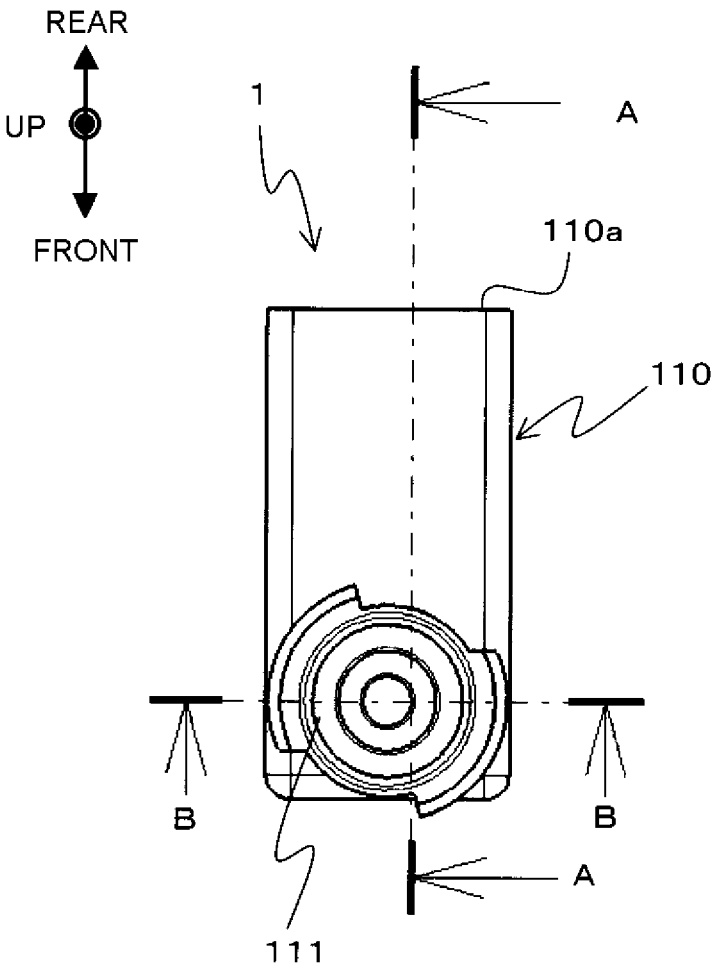
FIG. 2 is a top view of the LED lighting unit with an electric-wire holding part in FIG. 1 removed.
Figure 3:
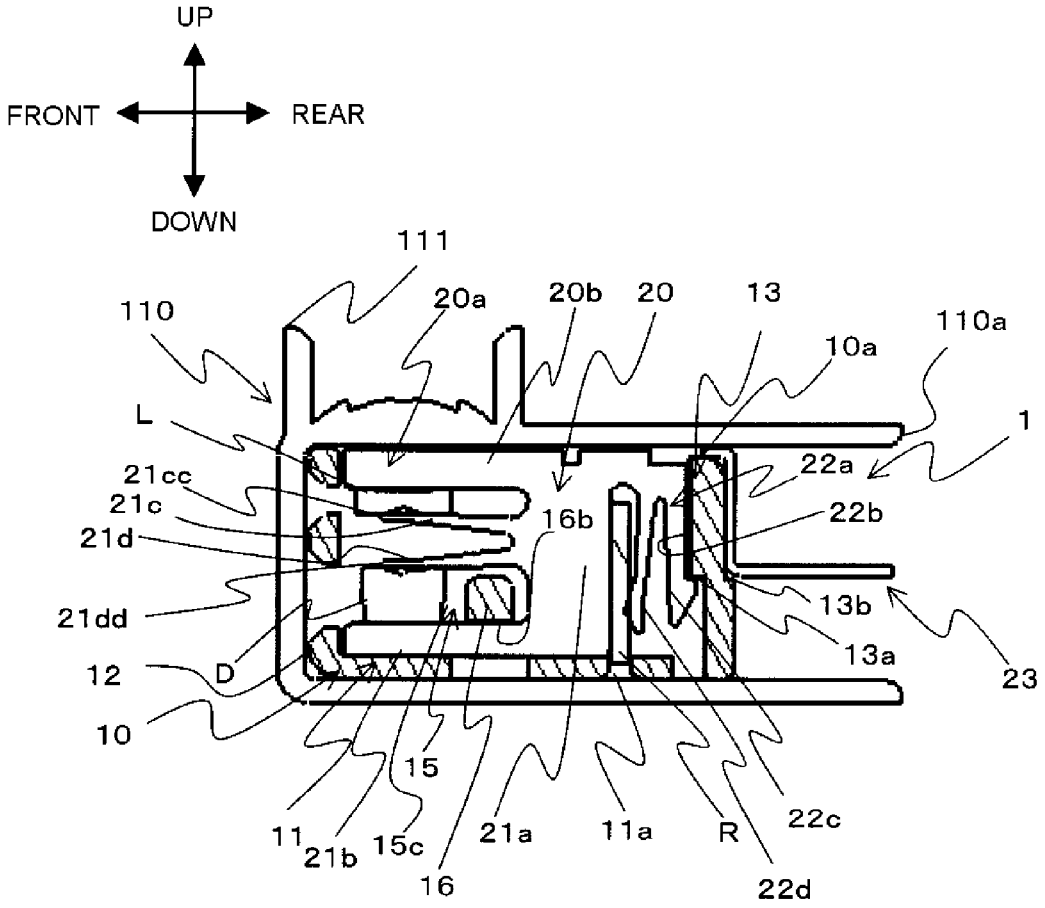
FIG. 3 is a cross-sectional view of the LED lighting unit shown in FIG. 2 as taken along line A-A.
Figure 4:
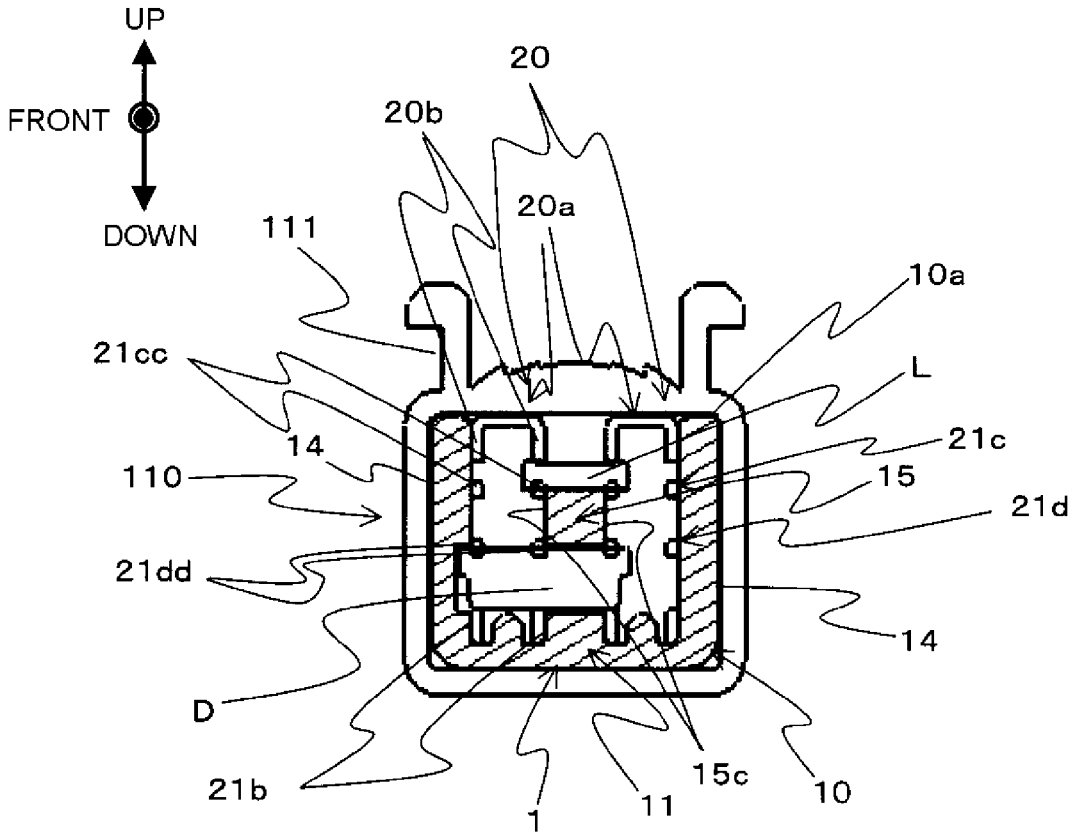
FIG. 4 is a cross-sectional view of the LED lighting unit shown in FIG. 2 as taken along line B-B.
Figure 5:
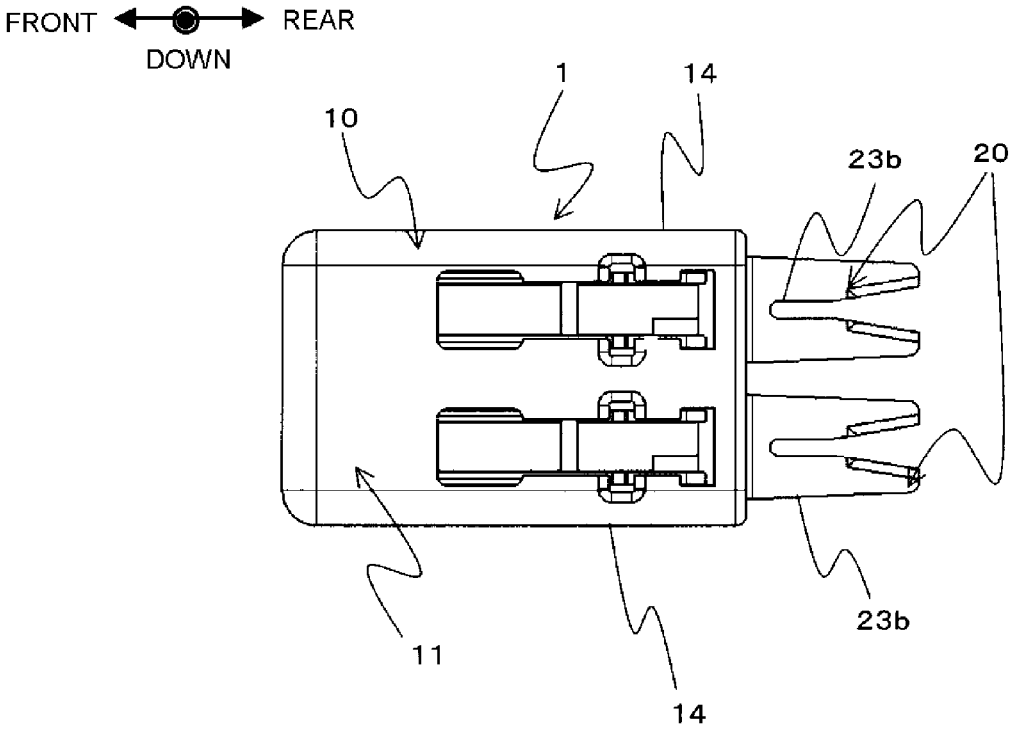
FIG. 5 is a bottom view of the electronic-component connection structure shown in FIG. 1.
Figure 6:
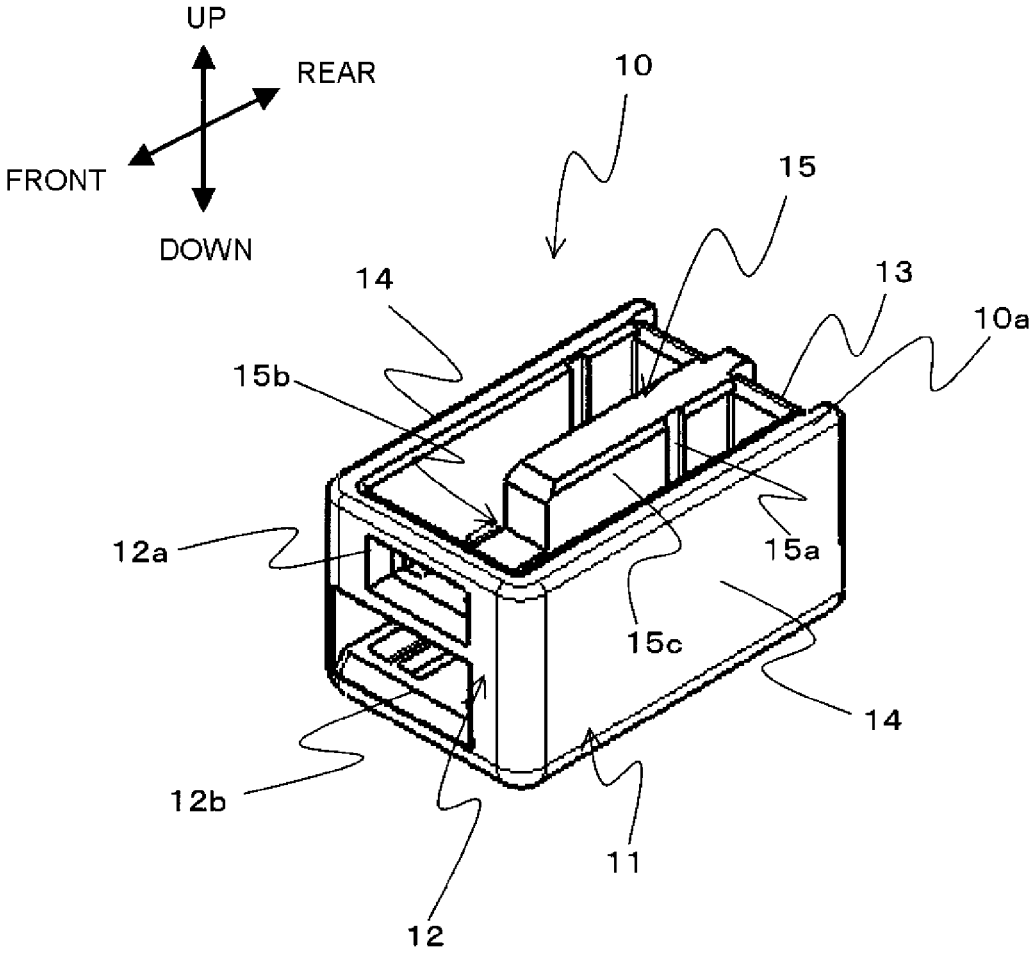
FIG. 6 is an enlarged perspective view of a housing shown in FIG. 1.
Figure 7:
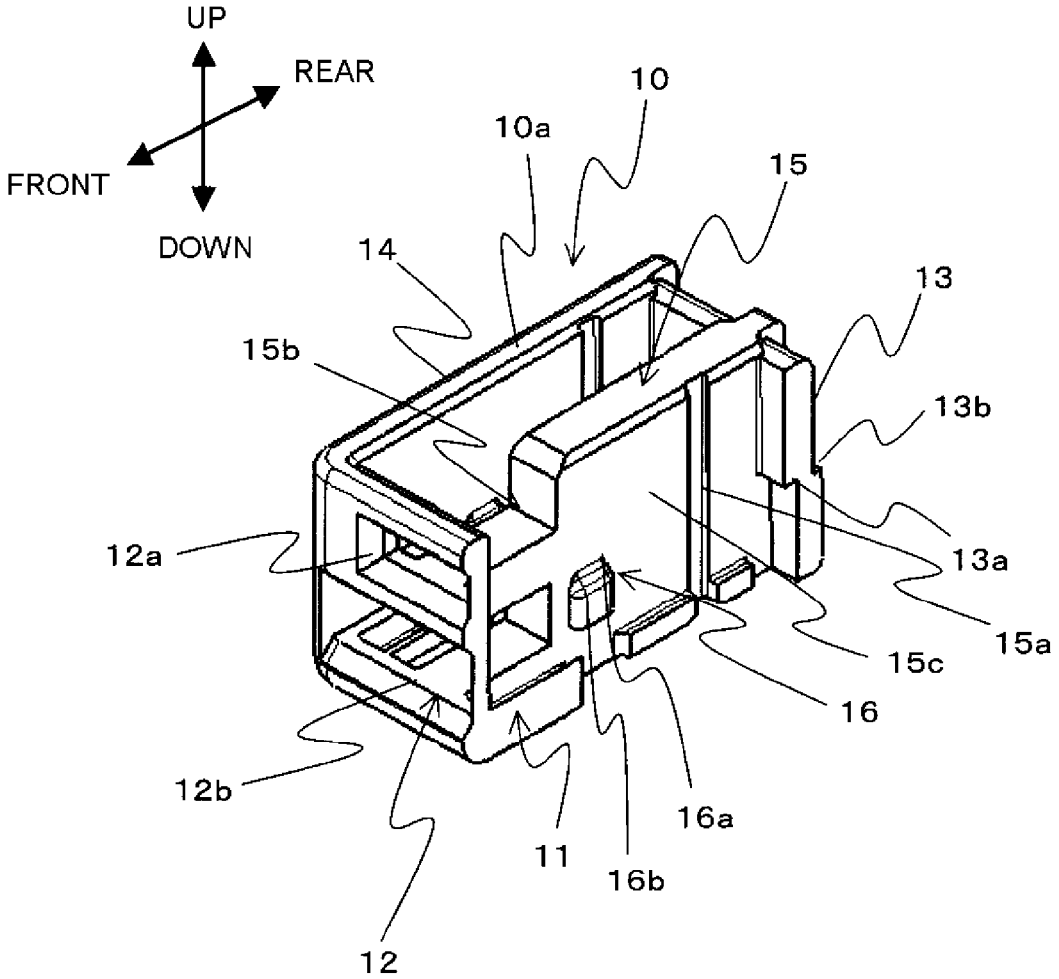
FIG. 7 is a cross-sectional view illustrating a portion of the housing shown in FIG. 6.
Figure 8:
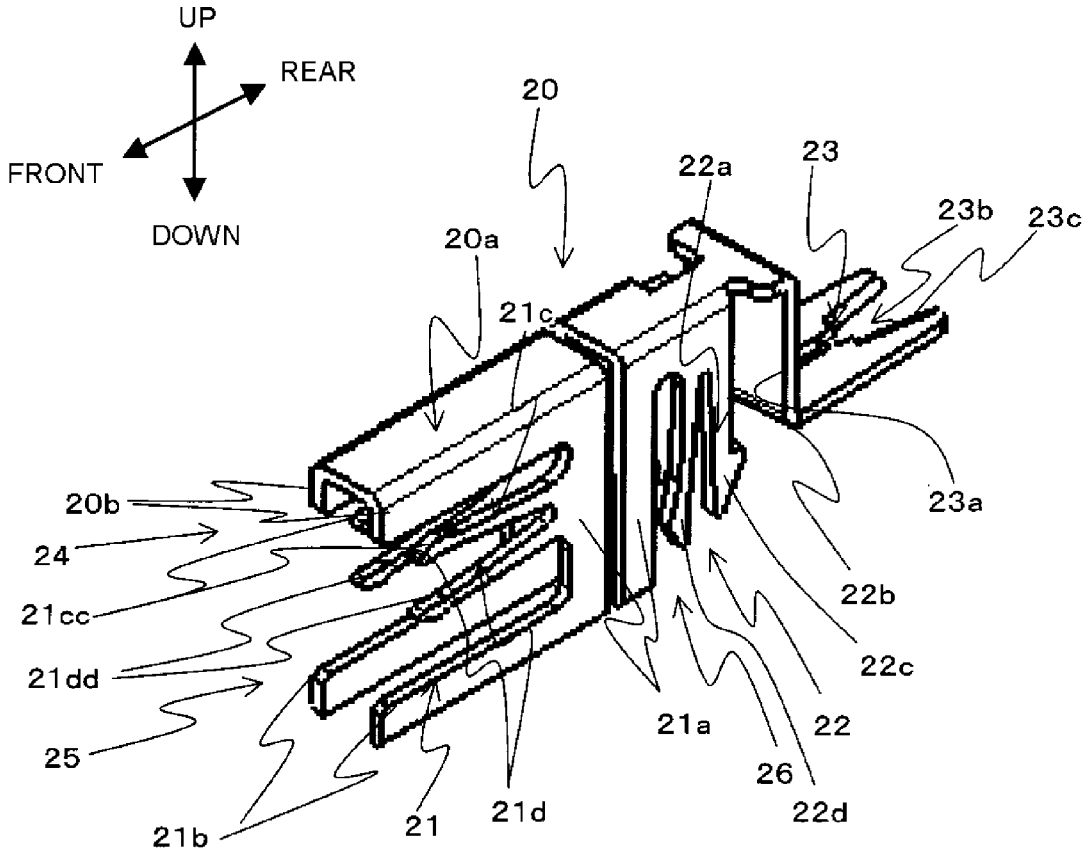
FIG. 8 is an enlarged perspective view of a terminal shown in FIG. 1.
Figure 9:
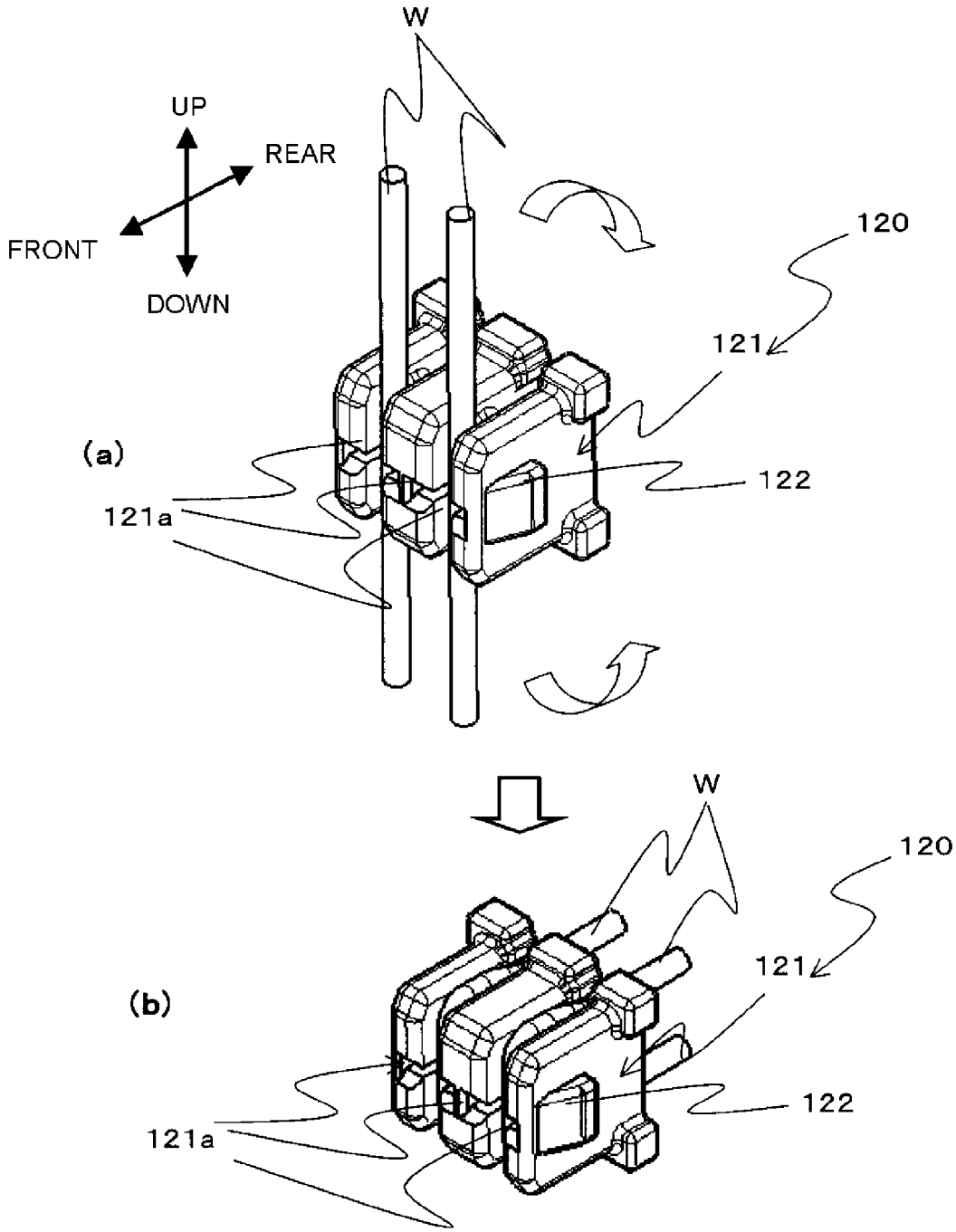
FIG. 9 is a diagram for explaining details of the electric-wire holding part shown in FIG. 1.
Figure 10:
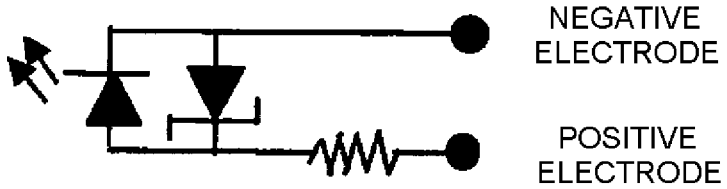
FIG. 10 is a circuit diagram illustrating a circuit configuration of the LED lighting unit shown in FIG. 1.

FIG. 1 is an exploded perspective view illustrating a structure of an LED lighting unit 100 having an electronic-component connection structure 1 according to an embodiment of the present invention. FIG. 2 is a top view of the LED lighting unit 100 with an electric-wire holding part 120 in FIG. 1 removed. FIG. 3 is a cross-sectional view of the LED lighting unit 100 shown in FIG. 2 as taken along line A-A. FIG. 4 is a cross-sectional view of the LED lighting unit 100 shown in FIG. 2 as taken along line B-B. FIG. 5 is a bottom view of the electronic-component connection structure 1 shown in FIG. 1. FIG. 6 is an enlarged perspective view of a housing 10 shown in FIG. 1. FIG. 7 is a cross-sectional view illustrating a portion of the housing 10 shown in FIG. 6. FIG. 8 is an enlarged perspective view of a terminal 20 shown in FIG. 1. FIG. 9 is a diagram for explaining details of the electric-wire holding part 120 shown in FIG. 1. FIG. 10 is a circuit diagram illustrating a circuit configuration of the LED lighting unit 100 shown in FIG. 1.

In FIGS. 1 to 10, for convenience, arrow directions are defined as a front side, a rear side, an upper side, and a lower (down) side.

The LED lighting unit 100 having the electronic-component connection structure 1 according to the embodiment of the present invention performs light irradiation of an LED element L by electrically connecting two electric wires with a pair of terminals 20. The LED lighting unit 100 includes a unit housing 110, the electronic-component connection structure 1, and the electric-wire holding part 120, as shown in FIG. 1.

First, the unit housing 110 will be described. The unit housing 110 accommodates the electronic-component connection structure 1 and the electric-wire holding part 120. The unit housing 110 is a casing having an opening 110*a* serving as an insertion opening for accommodating the electronic-component connection structure 1 and the electric-wire holding part 120 within the unit housing 110. Inside the unit housing 110, the electronic-component connection structure 1 and the electric-wire holding part 120 are disposed in the order of the electronic-component connection structure 1 and the electric-wire holding part 120 from the front side. Further, the unit housing 110 includes an opening 111 for illumination and an opening 112 for engagement.

The opening 111 for illumination is an opening formed at a wall forming an upper face of the unit housing 110, and is for emitting light emitted from the LED element L accommodated within the unit housing 110 toward the outside. The opening 111 for illumination may have a structure for enabling a light transmissive member such as a lens to be used as a lid.

The opening 112 for engagement is an opening formed at a side wall of the unit housing 110 in the vicinity of the opening 110*a*. The opening 112 for engagement is engaged with a lance portion 122 (to be described below) of the electric-wire holding part 120. In other words, the opening 112 for engagement can be engaged with the lance portion 122 so as to fix the electronic-component connection structure 1 and the electric-wire holding part 120 within the unit housing 110.

Next, the electronic-component connection structure 1 will be described. The electronic-component connection structure 1 includes the housing 10, and a pair of terminals 20 that is accommodated within the housing 10. The electronic-component connection structure 1 is for electrically connecting electronic components accommodated inside the housing 10 by the pair of terminals 20 fixed within the housing 10. In other words, the electronic-component connection structure 1 electrically connects the LED element L, a Zener diode D, and a resistor R as electronic components, and accommodates the LED element L, the Zener diode D, and the resistive plate R within the housing 10. In a case where the electronic-component connection structure 1 is accommodated within the unit housing 110, as shown in FIG. 3, the LED element L is disposed at a position corresponding to the opening 111 for illumination, and press-contact terminal portions 23*b* (to be described below) to be connected with individual electric wires W are directed toward the opening 110*a* of the unit housing 110.

The housing 10 is a casing which is made of an insulating material to have an opening 10*a* at the upper face thereof. The housing 10 includes a rectangular bottom wall 11, and a front wall 12, a rear wall 13, and a pair of side walls 14 provided to stand from four sides of the bottom wall 11, as shown in FIGS. 5 to 7. The rear wall 13 faces the front wall 12, and the pair of side walls 14 faces each other. Further, the housing 10 includes an LED-element insertion opening 12*a*, a Zener-diode insertion opening 12*b*, a resistive-plate insertion opening 11*a*, a separation wall 15, and a terminal-fixing part 16.

The LED-element insertion opening 12*a* is an opening formed at the front wall 12 for inserting the LED element L into the housing 10.

The Zener-diode insertion opening 12*b* is an opening formed at the front wall 12 for inserting the Zener diode D into the housing 10.

The resistive-plate insertion opening 11*a* is an opening formed at the bottom wall 11 for inserting the resistive plate R into the housing 10.

The separation wall 15 is a wall which is provided at a position between the side walls 14 facing each other to stand from the bottom wall 11 in parallel with the side walls 14 and divides the accommodation space in the housing 10 into two accommodation spaces almost equal to each other. The two accommodation spaces in the housing 10 accommodate corresponding terminals 20. Therefore, the terminals 20 are accommodated within the housing 10 while maintaining an insulation state without being in contact with each other.

In a wall surface of the separation wall 15 and a side surface of the side walls 14 facing the corresponding wall surface of the separation wall 15, a pair of straight grooves 15*a* is formed in a vertical direction, and functions as a guide for disposing the resistive plate R at a connection position of a corresponding terminal 20 in the housing 10.

Further, at positions of a front end portion of the separation wall 15 corresponding to the LED-element insertion opening 12*a* and the Zener-diode insertion opening 12*b*, notch portions 15*b* are formed to allow the LED element L and the Zener diode D to be accommodated within the housing 10.

The terminal-fixing part 16 is formed to protrude from a wall surface 15*c* of the separation wall 15 as shown in FIG. 3, and clamps the terminals 20 in cooperation with the bottom wall 11 of the housing 10 so as to fix each terminal 20 in the housing 10.

Next, the terminals 20 will be described.

Each terminal 20 is formed integrally by a pressing work on a conductive plate-shaped member. As shown in FIG. 8, each terminal 20 includes a first component-connection portion 21 and a second component-connection portion 22 formed by bending both longitudinal sides of a rectangular top board portion 20*a* downward, and an electric-wire connection portion 23 formed by bending a rear end portion of the top board portion 20*a* downward and then bending the rear end portion toward the rear side. The top board portion 20*a* includes a pair of bent edge portions 20*b* formed by bending both edges, forming the both longitudinal edges of the top board portion 20*a*, downward.

The first component-connection portion 21 includes a pair of base portions 21*a* provided to stand from both edge of the top board portion 20*a*, a pair of protrusion pieces 21*b* extending from lower edges of the base portions 21*a* toward the front side (in a lateral direction), and a pair of first contact pieces 21*c* and a pair of second contact pieces 21*d* protruding from the base portions 21*a* between the top board portion 20*a* and the pair of protrusion pieces 21*b* toward the front side (in the lateral direction).

The pair of first contact pieces 21*c* extends toward end portions 21*cc* to shorten distances from the top board portion 20*a*. The pair of first contact pieces 21*c* has elasticity.

The pair of second contact pieces 21*d* is formed below the pair of first contact pieces 21*c* to extend toward end portions 21*dd* such that distances from the protrusion pieces 21*b* are shortened. The pair of second contact pieces also has elasticity.

Each first contact piece 21*c* having this structure includes an LED-element connection portion 24 to be electrically connected with the LED element L, and a Zener-diode connection portion 25 to be electrically connected with the Zener diode D.

The LED-element connection portion 24 clamps the LED element L by the pair of bent edge portions 20*b* of the top board portion 20*a* and the pair of first contact pieces 21*c*. In other words, the LED element L is inserted between the pair of bent edge portions 20*b* and the pair of first contact pieces 21*c*, such that the LED element L is clamped by the elasticity of the pair of first contact pieces 21*c*, and the pair of terminals 20 and the LED element L are electrically connected.

The Zener-diode connection portion 25 clamps the Zener diode D by the pair of protrusion pieces 21*b* and the pair of second contact pieces 21*d*. In other words, the Zener diode D is inserted between the pair of protrusion pieces 21*b* and the pair of second contact pieces 21*d*, such that the Zener diode D is clamped by the elasticity of the pair of second contact pieces 21*d* and the pair of terminals 20 and the Zener diode D are electrically connected.

The second component-connection portion 22 includes a pair of base portions 21*a*, and a pair of engagement portions 22*a* and a pair of third contact pieces 22*d* provided to stand from both edges of the top board portion 20*a*.

The pair of engagement portions 22*a* includes main end surface portions 22*b* and hook-like portions 22*c*.

The main end surface portions 22*b* have end surfaces formed to extend vertically. In a case where the terminals 20 are accommodated within the housing 10, the main end surface portions 22*b* are brought into surface-contact with an inner surface of the rear wall 13 as shown in FIG. 3.

The hook-like portions 22*c* are portions formed in a hook shape at lower portions of the engagement portions 22*a*. In the case where the terminals 20 are accommodated within the housing 10, the hook-like portions 22*c* are engaged with an inner-surface-side step 13*a* formed on the inner surface side of the rear wall 13, as shown in FIG. 3.

The pair of third contact pieces 22*d* is a pair of elastic pieces extending from the top board portion 20*a* between the pair of base portions 21*a* and the pair of engagement portions 22*a* downward, as shown in FIG. 8. The pair of third contact pieces 22*d* extends toward the end portions to shorten distances from the pair of base portions 21*a*.

The second component-connection portion 22 having the above-mentioned structure includes a resistive-plate connection portion 26 to be electrically connected with the resistive plate R.

The resistive-plate connection portion 26 clamps the resistive plate R by the pair of base portions 21*a* and the pair of third contact pieces 22*d*. In other words, the resistive plate R is inserted between the pair of base portions 21*a* and the pair of third contact pieces 22*d*, such that the resistive plate R is clamped by the elasticity of the pair of third contact pieces 22*d* and the terminals 20 and the resistive plate R are electrically connected.

The electric-wire connection portion 23 includes a wall-surface contact portion 23*a* and a press-contact terminal portion 23*b*. The wall-surface contact portion 23*a* is a portion formed by bending the top board portion 20*a* downward. The wall-surface contact portion 23*a* is formed in a bent shape along an outer surface including an upper end surface of the rear wall 13 when the terminals 20 are accommodated within the housing 10, as shown in FIG. 3.

The press-contact terminal portion 23*b* is a portion formed by bending from the downwardly-bent wall-surface contact portion 23*a* toward the rear side, as shown in FIG. 8. The press-contact terminal portion 23*b* has a notch 23*c* formed in a U shape. When the electric wire W is pressed into the notch 23*c*, the electric wire W and the terminals 20 are electrically connected.

A bent portion serving as a boundary between the wall-surface contact portion 23*a* and the press-contact terminal portion 23*b* is formed to be engaged with an outer-surface-side step 13*b* formed at the rear wall 13, as shown in FIG. 3. Therefore, the terminals 20 clamp the rear wall 13 by the wall-surface contact portion 23*a* and the pair of engagement portions 22*a*.

Now, the terminal-fixing parts 16 will be described in more detail.

The terminal-fixing parts 16 are formed to protrude from the side surface of the separation wall 15 at the vicinities of the pair of base portions 21*a* between the pair of protrusion pieces 21*b* and the pair of second contact pieces 21*d* of each terminal 20 when each terminal 20 of the pair of terminals 20 is accommodated within the housing 10, as shown in FIG. 3, and clamp the protrusion pieces 21*b* in cooperation with the bottom wall 11 of the housing 10 so as to fix each terminal 20 within the housing 10.

More specifically, the terminal-fixing parts 16 are formed to protrude from both side surfaces of the separation wall 15 into the two accommodation spaces of the housing 10, as shown in FIG. 7. Further, each terminal-fixing part 16 includes an inclined surface 16*a* having an upper end and a lower end which is closer to the bottom wall, the lower end of the inclined surface being more separate away from the separation wall 15 than the upper end. Each terminal-fixing part 16 further includes a lower end surface 16*b* which is a flat surface having a normal line oriented in the vertical direction. Therefore, in the case where the terminals 20 are accommodated within the housing 10, as shown in FIG. 3, the pair of protrusion pieces 21*b* is clamped and fixed between the terminal-fixing part 16 and the bottom wall 11 at positions between the lower end surface 16*b* of the terminal-fixing part 16 and the upper surface of the bottom wall 11.

Although the pair of second contact pieces 21*d* extend such that the distances from the protrusion pieces 21*b* are shortened toward the end portions 21*dd*, since the terminal-fixing parts 16 are disposed in dead spaces which are in the vicinities of the base portions 21*a* and where the second contact pieces 21*d* and the protrusion pieces 21*b* are distant from each other, the terminal-fixing parts 16 and the second contact pieces 21*d* do not interfere with each other.

Next, the electric-wire holding part 120 will be described.

The electric-wire holding part 120 holds a bent portion of each electric wire W formed by turning each electric wire W back, and is accommodated within the unit housing 110 in that state, as shown by (a) to (b) in FIG. 9, so as to electrically connect each electric wire W to each terminal 20 in the unit housing 110.

The electric-wire holding part 120 holds two electric wires W to be electrically connected to each terminal 20 of the pair of terminals 20. Further, the electric-wire holding part 120 includes a bend-holding portion 121 and the lance portion 122.

The bend-holding portion 121 is for holding the bent portion of each electric wire W formed by turning each electric wire W back. The bend-holding portion 121 is formed to be inserted into the unit housing 110 up to a position at which the bent portion of each electric wire W is brought into contact with each press-contact terminal portion 23*b* by pressurizing. Further, the bend-holding portion 121 includes notches 121*a* formed at the front end portion such that the press-contact terminal portions 23*b* are connected to the electric wires W.

The lance portion 122 is engaged with engagement openings 112 formed at the unit housing 110 so as to fix the electric-wire holding part 120 within the unit housing 110.

The electric-wire holding part 120 bends and holds each electric wire W, and then is accommodated within the unit housing 110, such that the pair of press-contact terminal portions 23*b* are electrically connected to the corresponding electric wires W.

The LED lighting unit 100 having the above-mentioned configuration is configured by connecting the LED element L and the Zener diode D in parallel as shown in FIG. 10, such that the LED element L is protected from an over-voltage.

Next, an assembly procedure of the LED lighting unit 100 having the electronic-component connection structure 1 according to the embodiment of the present invention will be described with reference to FIGS. 11 to 15. FIGS. 11 to 15 are diagrams for illustrating an assembly procedure of the LED lighting unit 100 having the electronic-component connection structure 1 according to the embodiment of the present invention.

Figure 11:
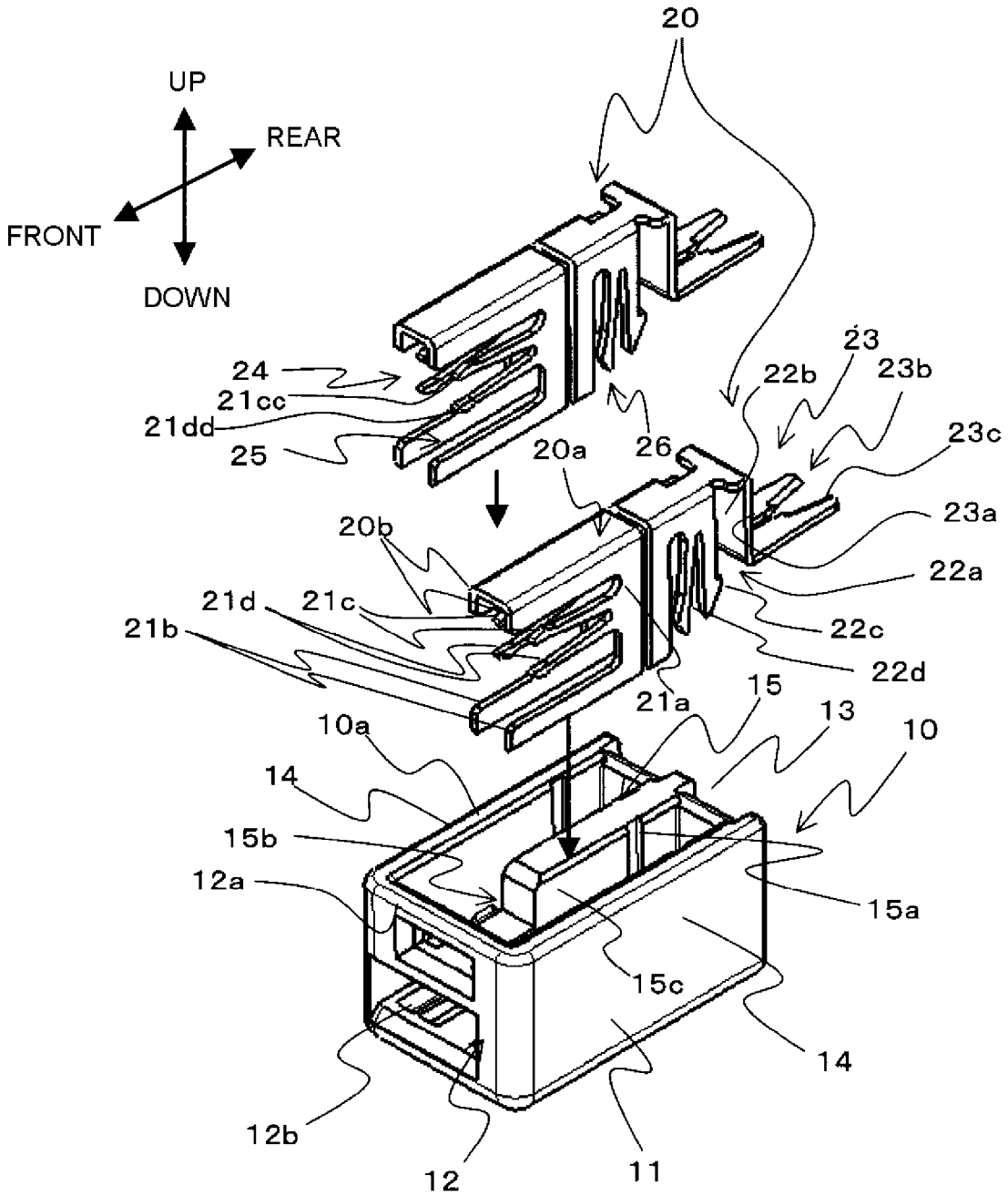
FIG. 11 is a diagram for illustrating an assembly procedure of the LED lighting unit having the electronic-component connection structure according to the embodiment of the present invention.

First, a worker accommodates the pair of terminals 20 within the housing 10, as shown in FIG. 11. At this time, each terminal 20 is inserted from the opening 10*a* of the housing 10. In this case, each terminal 20 smoothly moves the wall surfaces of the protrusion pieces 21*b* on the separation wall 15 side while bringing into contact with the wall surfaces with the inclined surfaces 16*a* of the terminal-fixing parts 16, and is fixed in the housing 10 such that the protrusion pieces 21*b* are positioned between the lower end surface 16*b* of the terminal-fixing part 16 and the upper surface of the bottom wall 11.

Figure 12:
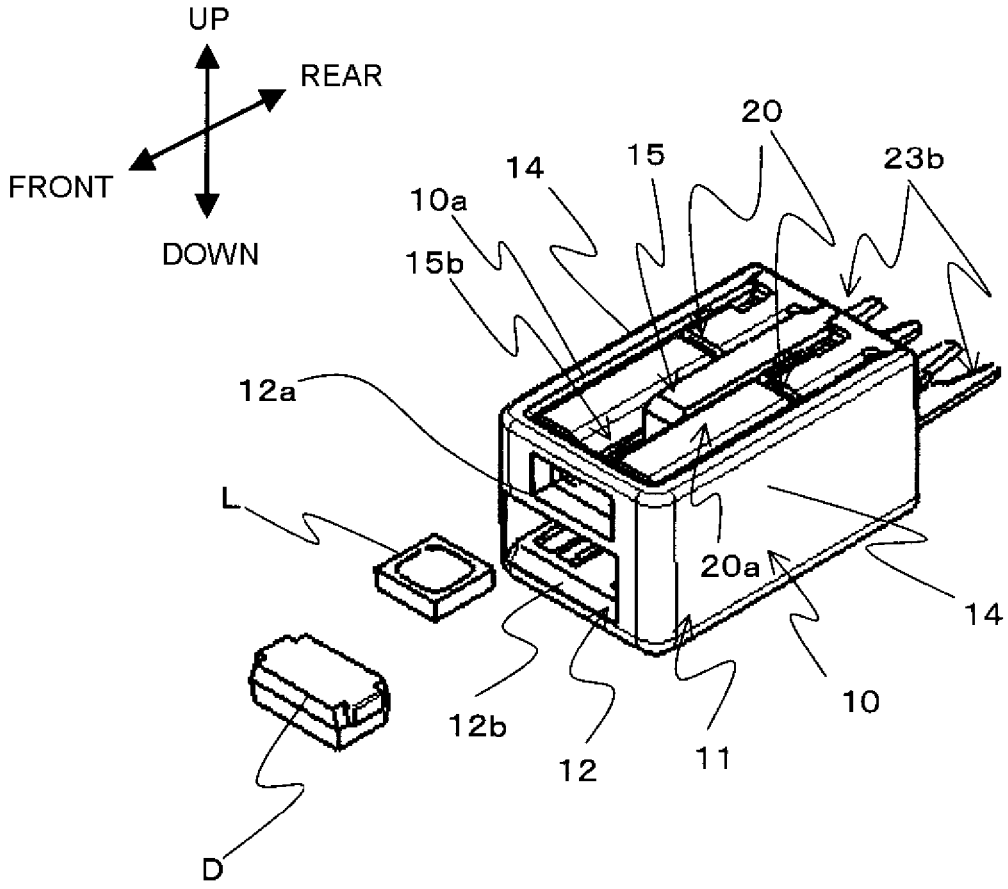
FIG. 12 is a diagram for illustrating the assembly procedure of the LED lighting unit having the electronic-component connection structure according to the embodiment of the present invention.

Then, the worker connects the LED element L and the Zener diode D to the pair of terminals 20 as shown in FIG. 12. More specifically, the LED element L is inserted from the LED-element insertion opening 12*a* into the housing 10, and is disposed between the pair of bent edge portions 20*b* and the pair of the first contact pieces 21*c*. At this time, the LED element L is inserted while widening gaps between the pair of bent edge portions 20*b* and the pair of first contact pieces 21*c* by using the elasticity of the pair of first contact pieces 21*c*. Therefore, a biasing force is applied toward the pair of bent edge portions 20*b* by the pair of first contact pieces 21*c*, such that the LED element L is held between the pair of bent edge portions 20*b* and the pair of first contact pieces 21*c*, as shown in FIG. 3.

The Zener diode D is inserted from the Zener-diode insertion opening 12*b*, and is disposed between the pair of protrusion pieces 21*b* and the pair of second contact pieces 21*d*. At this time, the Zener diode D is inserted while widening gaps between the pair of protrusion pieces 21*b* and the pair of second contact pieces 21*d* by using the elasticity of the pair of second contact pieces 21*d*. Therefore, a biasing force is applied toward the pair of protrusion pieces 21*b* by the pair of second contact pieces 21*d*, such that the Zener diode D is held between the pair of protrusion pieces 21*b* and the pair of second contact pieces 21*d*, as shown in FIG. 3.

Figure 13:
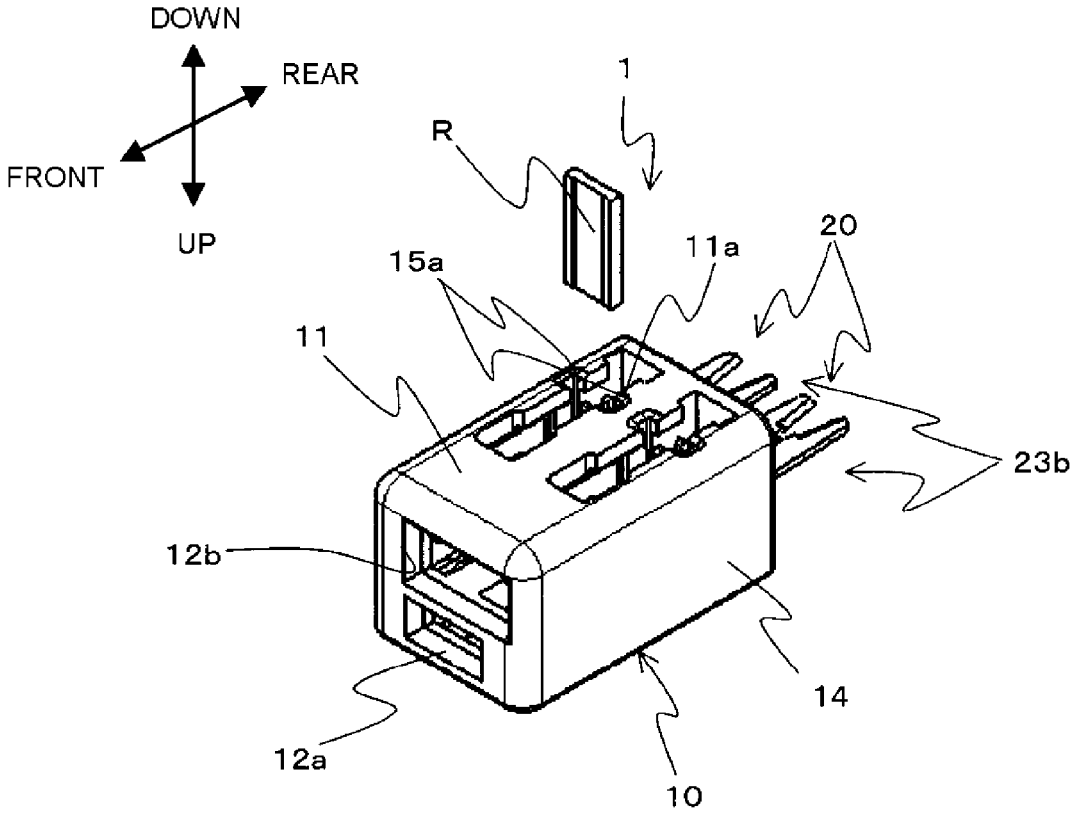
FIG. 13 is a diagram for illustrating the assembly procedure of the LED lighting unit having the electronic-component connection structure according to the embodiment of the present invention.

Next, the worker connects the resistive plate R to the pair of terminals 20 as shown in FIG. 13. At this time, the resistive plate R is inserted from the resistive-plate insertion opening 11*a* into the housing 10 while being guided by the pair of grooves 15*a*, and is disposed between the pair of base portions 21*a* and the pair of third contact pieces 22*d*. Further, the resistive plate R is inserted while widening gaps between the base portions 21*a* and the pair of third contact pieces 22*d* by using the elasticity of the pair of third contact pieces 22*d*. Therefore, a biasing force is applied toward the pair of base portions 21*a* by the pair of third contact pieces 22*d*, such that the resistive plate R is held between the pair of base portions 21*a* and the pair of third contact pieces 22*d*, as shown in FIG. 3.

By the above-mentioned assembly work, the electronic-component connection structure 1 is completed.

Figure 14:
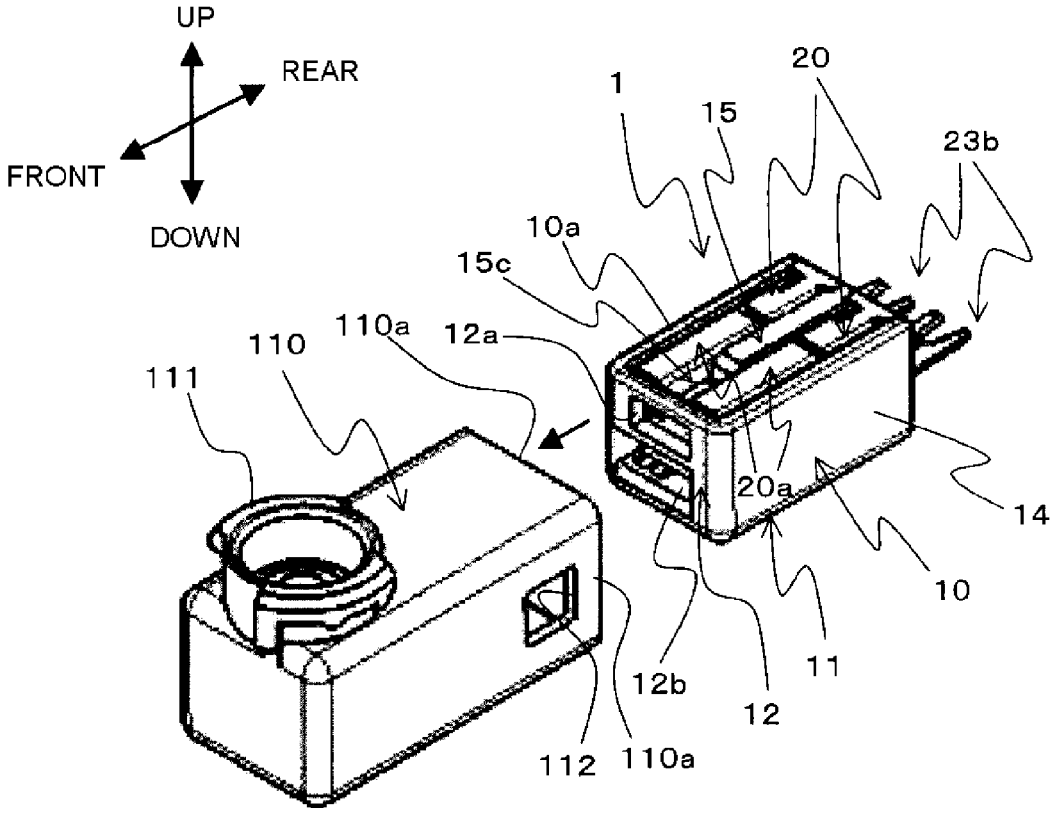
FIG. 14 is a diagram for illustrating the assembly procedure of the LED lighting unit having the electronic-component connection structure according to the embodiment of the present invention.

Next, the worker accommodates the electronic-component connection structure 1 within the unit housing 110 as shown in FIG. 14. Therefore, the LED element L is disposed at a position corresponding to the opening 111 for illumination of the unit housing 110. Further, the press-contact terminal portions 23*b* of the pair of terminals 20 are disposed toward the opening 110*a* side of the unit housing 110.

Figure 15:
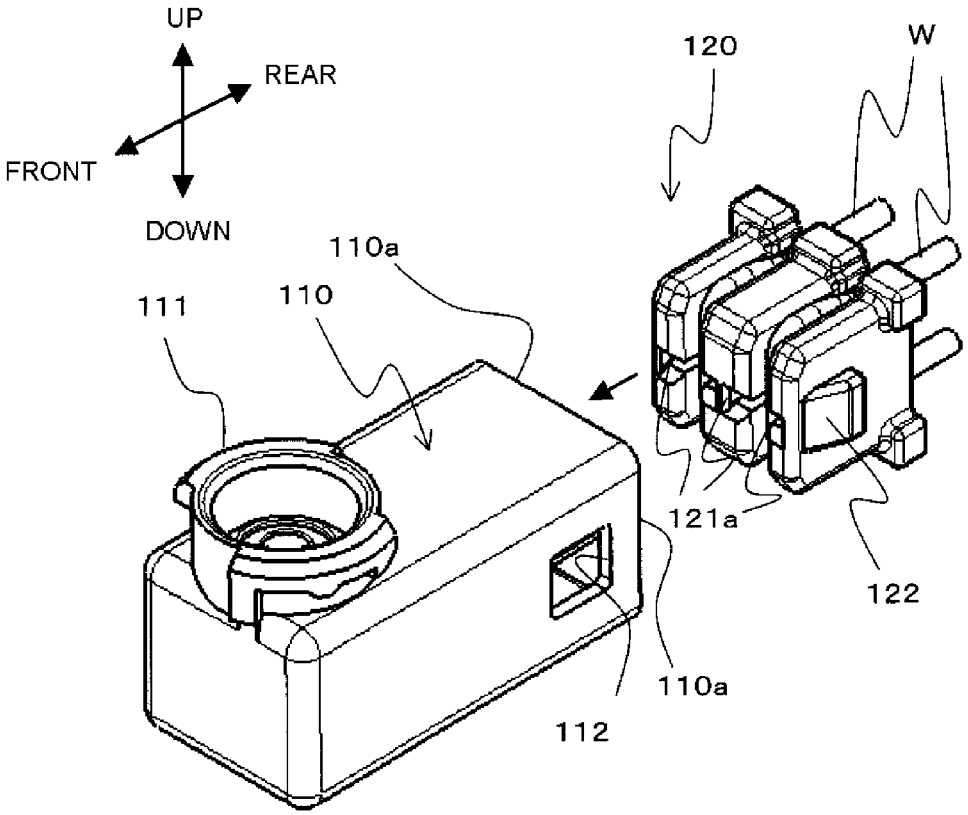
FIG. 15 is a diagram for illustrating the assembly procedure of the LED lighting unit having the electronic-component connection structure according to the embodiment of the present invention.

Next, the worker accommodates the electric-wire holding part 120 within the unit housing 110 as shown in FIG. 15. In this way, the LED lighting unit 100 is completed. When the electric-wire holding part 120 is pressed from the opening 110*a* of the unit housing 110 up to a predetermined position in the unit housing 110, each electric wire W is pressed into the notch 23*c* of each press-contact terminal portion 23*b*, such that each electric wire W and a corresponding terminal 20 are electrically connected. As described above, since the lance portions 122 are engaged with the engagement openings 112 of the unit housing 110 with each electric wire W and a corresponding terminal 20 electrically connected, the electric-wire holding parts 120 are fixed in the unit housing 110 in a state in which the connection of each electric wire W and a corresponding terminal 20 is maintained.

According to the electronic-component connection structure 1 in the embodiment of the present invention, each terminal 20 is not required to protrude a fixing means in a vertical direction, and it is possible to fix each terminal 20 in the housing 10 by effectively using the dead spaces between the pair of protrusion pieces 21*b* and the pair of second contact pieces 21*d*. Therefore, it is possible to fix each terminal 20 in the housing 10 without increasing a dimension in the vertical direction, and thus reduce the thickness.

Further, according to the electronic-component connection structure 1 in the embodiment of the present invention, since the terminal-fixing part 16 is formed at the side surface 15*a* of the separation wall 15, it is possible to fix each terminal 20 in the housing 10 without increasing the dimension in the vertical direction.

Furthermore, according to the electronic-component connection structure 1 in the embodiment of the present invention, since the housing 10 has an opened upper face, and the terminal-fixing parts 16 clamp the pair of protrusion pieces 21*b* of each terminal 20 in cooperation with the bottom wall 11 of the housing 10, it is possible to fix each terminal 20 in the housing 10 without providing a wall at the upper face of the housing 10, and thus reduce the thickness.

Moreover, according to the electronic-component connection structure 1 in the embodiment of the present invention, since each terminal-fixing part 16 has the inclined surface 16*a* having an upper end and a lower end which is closer to the bottom wall, the lower end of the inclined surface being more separate away from the separation wall 15 than the upper end, when each terminal 20 is accommodated from over the housing 10 into the housing 10, it is possible to easily dispose the protrusion pieces 21*b* between the terminal-fixing part 16 and the bottom wall 11.

Modification

Figure 16:
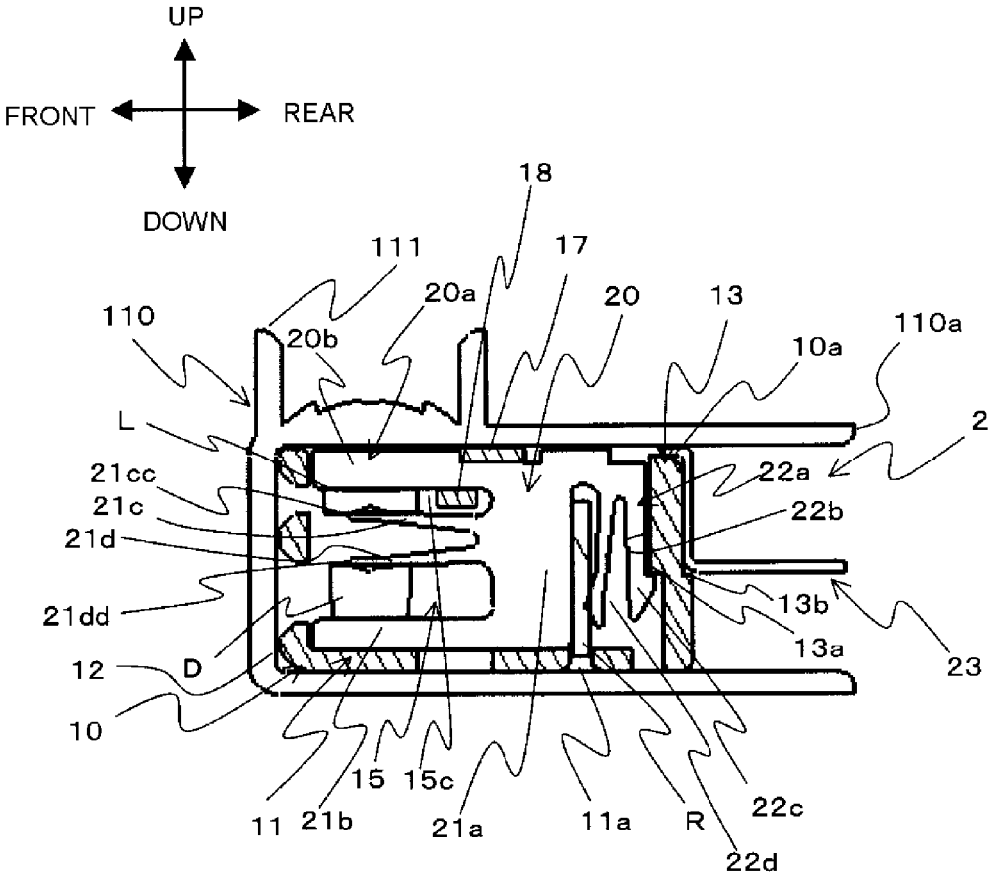
FIG. 16 is a diagram for illustrating a modification of the electronic-component connection structure according to the embodiment of the present invention.

Now, a modification of the electronic-component connection structure 1 in the embodiment of the present invention will be described with reference to FIG. 16. FIG. 16 is a diagram for illustrating a modification of the electronic-component connection structure 1 in the embodiment of the present invention.

In the electronic-component connection structure 1 of the embodiment of the present invention, the terminal-fixing parts 16 clamp the terminals 20 in cooperation with the bottom wall 11 of the housing 10. However, in an electronic-component connection structure 2 according to the modification, terminal-fixing parts 18 clamp the terminals 20 in cooperation with an upper wall 17 forming the upper face of the housing 10.

The terminal-fixing parts 18 are formed to protrude at the vicinities of the pair of base portions 21*a* from the side surfaces of the separation wall 15 between the top board portion 20*a* of each terminal 20 and the pair of first contact pieces 21*c* in the case where each terminal 20 of the pair of terminals 20 is accommodated within the housing 10. The terminal-fixing part 18 clamps the top board portion 20*a* in cooperation with the upper wall 17 of the housing 10, and fixes each terminal 20 in the housing 10. In other words, the top board portion 20*a* extends from the base portion 21*a* in the horizontal direction, so as to have the same function as that of the protrusion pieces 21*b*. Therefore, according to the electronic-component connection structure 2 in this modification, similarly to the electronic-component connection structure 1 of the embodiment, it is possible to fix each terminal 20 in the housing 10 without increasing the dimension in the vertical direction, and thus reduce the thickness.

Further, the upper wall 17 in this modification may be formed partly at the upper face of the housing 10 as long as the upper wall 17 can clamp the terminals 20 in cooperation with the terminal-fixing part 18.

Furthermore, more preferably, the terminals 20 may be formed such that vertical thicknesses of portions of the terminals 20 to be clamped by the terminal-fixing parts 16 are small. In this case, even if the upper wall 17 is provided, the thickness in the vertical direction does not increase.

In the electronic-component connection structure 1 according to the embodiment of the present invention, one pair of terminals 20 is used. However, the present invention is not limited thereto. In other words, two or more terminals to be electrically connected to electronic components may be provided.

In the electronic-component connection structure 1 according to the embodiment of the present invention, each terminal 20 is formed by pressing on the plate-shaped member. However, the present invention is not limited thereto. In other words, each terminal may include a base portion 21*a*, a protrusion piece 21*b* or a top board portion 20*a* extending from the base portion 21*a* in a lateral direction, and a contact piece which extends in the lateral direction such that a distance from the protrusion piece 21*b* or the top board portion 20*a* decreases from the base portion 21*a* toward an end portion, and has elasticity.

In the electronic-component connection structure 1 according to the embodiment of the present invention, the terminal-fixing parts 16 are formed at the side surfaces of the separation wall 15. However, the present invention is not limited thereto. In other words, each terminal 20 may be formed to protrude from the wall surface of the housing 10 in the vicinity of the pair of base portions 21*a* between the pair of protrusion pieces 21*b* and the pair of second contact pieces 21*d* in a case where each terminal 20 is accommodated in the housing 10. For example, the terminal-fixing parts 16 may be formed at the side walls 14.

In the electronic-component connection structure 1 according to the embodiment of the present invention, as the electronic components, the LED element L, the Zener diode D, and the resistive plate R are electrically connected to the pair of terminals 20. However, the present invention is not limited thereto. In other words, other electronic components may be connected to the pair of terminals 20.

The present invention is not limited by the embodiment and the modification as mentioned above.

What is claimed is:

1. A connection structure, comprising:

a box-shaped housing having at least side walls which face each other;

a pair of terminals which are inserted into the housing to be fixed inside the housing vertically in parallel to planes of the side walls; and an electronic component which is accommodated inside the housing by being connected to the pair of terminals, wherein each terminal of the pair of terminals includes:

a base portion;

a protrusion piece extending from the base portion in a lateral direction parallel to a bottom plane and the planes of the side walls of the housing; and an elastic contact piece extending from the base portion in the lateral direction so that a distance between the protrusion piece and the elastic contact piece becomes shorter towards an end of the elastic contact piece separate away from the base portion, wherein the housing includes a terminal-fixing part which is protruded from a wall surface of the housing at a position between the protrusion piece and the elastic contact piece near the base portion of the terminal when the terminal is inserted into the housing to clamp and fix the protrusion piece between the terminal-fixing part and one of a bottom wall or an upper wall of the housing.

2. The connection structure according to claim 1, wherein the terminal-fixing part is formed on a wall surface of the side walls of the housing.

3. The connection structure according to claim 1, wherein the housing includes a separation wall which divides an accommodation space in the housing into two accommodation spaces in which the pair of terminals are accommodate, respectively, and the terminal-fixing part is formed on a wall surface of the separation wall of the housing.

4. The connection structure according to claim 1, wherein the housing opens at an upper face, and the protrusion piece is clamped and fixed between the terminal-fixing part and the bottom wall of the housing.

5. The connection structure according to claim 4, wherein the terminal-fixing part includes an inclined surface having an upper end and a lower end which is closer to the bottom wall than the upper end, the lower end of the inclined surface being more separate away from the wall surface than the upper end.

* * * * *